US005211814A

United States Patent [19]

Jaakkola et al.

[11] Patent Number: 5,211,814

[45] Date of Patent: May 18, 1993

[54] WIRE LOADING DEVICE IN A PAPER MACHINE

[75] Inventors: Jyrki Jaakkola, Korpilahti; Michael Odell, Jyväskylä, both of Finland

[73] Assignee: Valmet Paper Machinery Inc., Finland

[21] Appl. No.: 829,953

[22] Filed: Feb. 3, 1992

[30] Foreign Application Priority Data

May 31, 1991 [FI] Finland ..... 912630
Oct. 17, 1991 [FI] Finland ..... 914913

[51] Int. Cl.[5] ..... D21F 1/00; D21F 1/54
[52] U.S. Cl. ..... 162/301; 162/352
[58] Field of Search ..... 162/300, 301, 352, 351, 162/354

[56] References Cited

U.S. PATENT DOCUMENTS 2,881,676 4/1959 Thomas ..... 162/301
3,027,940 4/1962 Dunlap ..... 162/352
3,066,068 11/1962 Calehuff et al. ..... 162/352
3,323,981 6/1967 Heys ..... 162/352
3,403,073 9/1968 Moran ..... 162/DIG. 7
3,438,854 4/1969 Means ..... 162/303
4,727,047 2/1988 Creagan et al. ..... 162/352
4,769,111 9/1988 Nevalainen et al. ..... 162/352
5,116,477 5/1992 Bubik et al. ..... 162/352

*Primary Examiner*—Karen M. Hastings
*Attorney, Agent, or Firm*—Steinberg & Raskin

[57] ABSTRACT

A wire loading device in a paper machine, by whose means a mechanical load is applied to the wire of the paper machine across its entire width, is disclosed. By means of this load, a pressure pulse is applied to the fiber layer or web supported by a wire or between wires. By means of the pressure pulse, the dewatering of the web is promoted, the formation of the web is improved, and/or the transverse profiles of different properties of the web are controlled, such as the transverse profiles of dewatering, filler distribution, formation, and/or retention. The loading device includes a plate-shaped spring blade, whose side is arranged as substantially parallel to the run of the wire or wires. The spring blade is adapted to drag against the inner face of a wire loop to produce a pressure pulse. The spring blade is attached, from outside its dragging area, to a frame part of the loading device. A loading force that produces the pressure pulse and curves the spring blade in the machine direction is produced by an intermediate of the frame part and/or loading devices.

25 Claims, 9 Drawing Sheets

WIRE LOADING DEVICE IN A PAPER MACHINE

BACKGROUND OF THE INVENTION

The present invention is related to a wire loading device in a paper machine, by whose means a mechanical load is applied to the wire of the paper machine, preferably across its entire width, and by means of which load a pressure pulse is applied to the fibre layer or web placed on support of a wire or between wires in order to promote the dewatering of the web, improve the formation of the web, and/or to control the transverse profiles of different properties of the web, such as the transverse profiles of dewatering, filler distribution, formation, and/or retention.

In the web forming sections of paper machines, a number of different forming members are employed. The principal function of these members is to provide a pressure pulsation in the fibre layer that is being formed, by means of which pulsation the dewatering of the web that is formed is promoted and, at the same time, its formation is improved. Also, in prior art, a number of different forming shoes are known, which are usually provided with a curved ribbed deck and over which the forming wires placed one above the other and the web placed between said wires are made to curve. In the area of these forming shoes, water is removed primarily through the web placed at the side of the outside curve, because of its tensioning pressure, and this dewatering is aided by the field of centrifugal force. The ribbed deck of the forming shoe produces pressure pulsation, which promotes the dewatering and improves the formation of the web.

In the prior art, various suction boxes and suction rolls, register rolls, forming ribs and foil ribs and doctors are known, by means of which a difference in pressure and pressure pulsation are produced in the fibre layer that is being formed, thus promoting the web formation and the dewatering.

For example, reference is made to U.S. Pat. Nos. 2,881,676 and 3,438,853 and to Patent Application WO 91/02842.

Attempts are made to construct the headboxes and the web forming components of a paper machine so that it should be possible to produce a paper that has a grammage, formation, and strength properties homogeneous across the entire width of the web, so that a minimum proportion of the paper at the edges of the web has to be cut off. From paper, in particular from fine paper, an ever higher homogeneity of the structure is required, which is required by printing and copying methods in which very rapid and intensive heating of the sheet takes place.

In order that homogeneous paper can be manufactured, an important requirement is that the main axes of the directional distribution, i.e. orientation, of the fiber mesh in the paper coincide with the directions of the main axes of the paper and that the orientation is symmetric with respect to these axes. For example, in the case of copying papers, it is important that the orientations at their top and bottom faces are substantially the same.

In view of achieving said objectives, as is known in prior art, various solutions for the control of the pulp suspension flows in a headbox have been employed, in whose respect reference is made by way of example to the assignee's FI Patent No. 75,377. However, also after the headbox, it is necessary to control the transverse homogeneity of the paper produced by various means, e.g. the transverse profile of the web in respect of dewatering, distribution of fillers, and retention.

One of the drawbacks with the use of the prior-art forming members is wire damage, which results from particles of impurities passing between the glide faces of the forming members and the wires, which particles may cause flattening and/or shifting of wire fibers, with resulting wire damage. This drawback occurs with particular emphasis when there are two forming members, such as forming ribs, placed one against the other in contact with the two wires, "hard against hard", the wires and the fiber web between them having to run between said forming ribs.

As a rule, the constructions of the prior-art web forming members are heavy, and a transverse bending occurs in said members, which drawback is increased to a great extent when the widths of paper machines are increased. The transverse profiling of the intensity of the pressure pulsation produced by said prior-art members is usually not possible without costly special arrangements.

The constantly increasing running speeds of paper machines have also brought about ever increasing requirements on the different web forming members.

OBJECTS AND SUMMARY OF THE INVENTION

It is an object of the present invention to provide a novel device for the loading of the wire of a paper machine so that the drawbacks discussed above can be substantially avoided.

A further object of the invention is to provide such a wire loading device of low-weight construction as is, as a rule, not supposed to change the direction of the wire or, in a twin-wire zone, wires and of the fiber web between the wires, but to apply a suitable pressure pulse to the wire and, through the wire, to the fiber web, by means of which pressure pulse the dewatering, formation and/or retention can be promoted.

An important of the invention is to provide a low-weight wire loading device by whose means it is possible to control transverse profiles in the web, such as the transverse profiles of dewatering, dry solids, distribution of fillers, retention, formation, and, in exceptional cases, also of grammage.

A further object of the invention is to provide a wire loading device that can be profiled and in which even considerable transverse deflections can be permitted, because said deflections can be compensated for by means of profiling.

It is a particular object of the invention to provide a device intended for wire loading that is suitable for use in particular in a curved twin-wire forming zone inside the loop of the wire placed at the side of the outside curve.

In certain embodiments, it is a further object of the invention to provide such an equipment that makes use of a loading device as described above in which the water that arrives along with the wire is not collected in front of the spring blades to a detrimental extent.

In certain embodiments, it is a further object of the invention is to provide such a device for loading of the draining and forming wires in which the spring blades in the equipment and the opposite forming ribs, which guide the wire and remove water, can be made jointly operative in a more favorable way than in prior art.

In view of achieving the objectives stated above and those that will come out later, the present invention relates to a loading device comprising a plate-shaped spring blade, whose side is arranged substantially parallel to the run of the wire or wires to drag against the inner face of the wire loop to produce a pressure pulse. The spring blade is attached from outside its dragging area to the frame part of the loading device, a loading force that produces said pressure pulse and curves the spring blade in the machine direction being produced by the intermediate of said frame part and/or loading devices such that said spring blade follows variations in the thickness of the fiber layer or web.

In a preferred embodiment of the invention, the spring blade extends in the transverse direction of the web and the wire across their entire width as a unified construction. The spring blade is fitted preferably "with the fur" in relation to the run of the wire and the web, which facilitates the prevention of damage caused by fibre lumps and increases the possibilities of resilience of the spring blade.

In a preferred embodiment of the invention, the forming ribs of the draining and wire loading device are placed alternatingly inside the wire loops placed one opposite the other and wire loading devices are fitted which are jointly operative with the forming ribs, inside the opposite wire loop. The wire loading devices comprise a plate-like spring blade, whose side is a arranged substantially parallel to the run of the wires. The wire loading devices drag along the inner face of the wire loop in the area of the forming rib placed inside the opposite wire loop and/or, in the direction of running of the wires, substantially immediately before the area of said rib. By means of this construction, collecting of water in front of the spring blades of the loading equipment can be prevented by, in a twin-wire zone, alternatingly fitting spring-blade units and forming ribs inside both of the wire loops and by wetting their mutual spacing so that, fitted one against the other, there are forming ribs and spring blades of the loading device in the twin-wire forming zone inside the opposite wire loops arranged in alternating fashion.

In accordance with the above, by alternating the forming ribs and the spring blades of the loading device inside the opposite wire loops, twin-wire forming zone is provided which is in wave form with very little amplitude and in which the alternation of the dewatering directions promotes the forming of the web and improves the formation.

A loading device in accordance with the invention provided with a spring blade is suitable for use in the web former in a number of different positions, as a rule, in a twin-wire area, but also even in the gap area of a gap former.

A loading device in accordance with the invention permits versatile controls and adjustments of the transverse profiles, wherein, if necessary, closed on-line regulation systems based on measurements of the different profiles can be used.

BRIEF DESCRIPTION OF THE DRAWINGS

In the following, the invention will be described in detail with reference to some exemplifying embodiments of the invention illustrated in the figures in the accompanying drawings, the invention being in no way strictly confined to the details of said embodiments.

DETAILED DESCRIPTION

Figure 1:
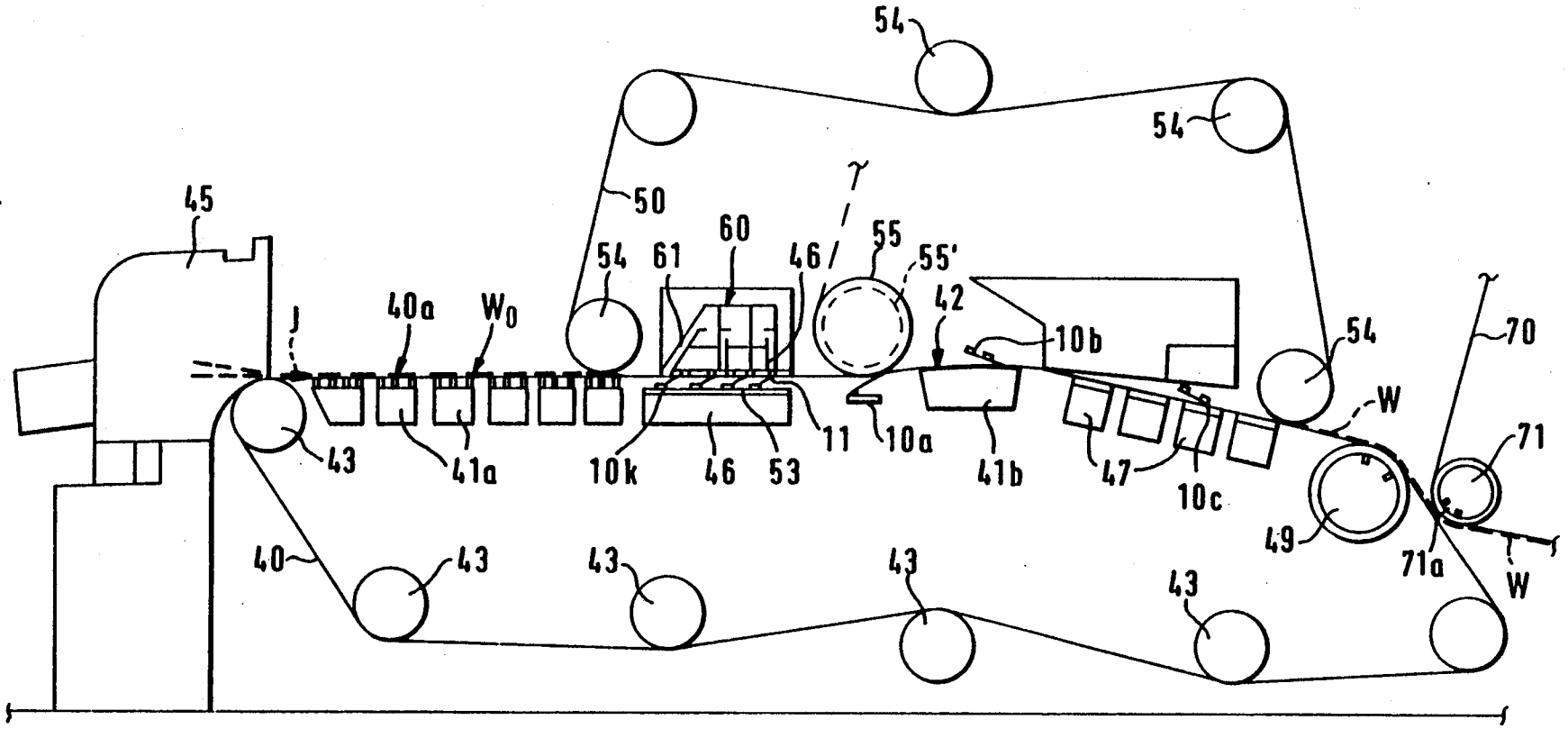
FIG. 1 shows a hybrid former provided with a MB TM unit in which former there are wire loading devices in accordance with the present invention in a number of different positions.

FIG. 1 shows an example of a hybrid former in which it is possible to employ loading devices 10*a*, 10*b*, 10*c* in accordance with the invention in a number of different positions.

Figure 15:
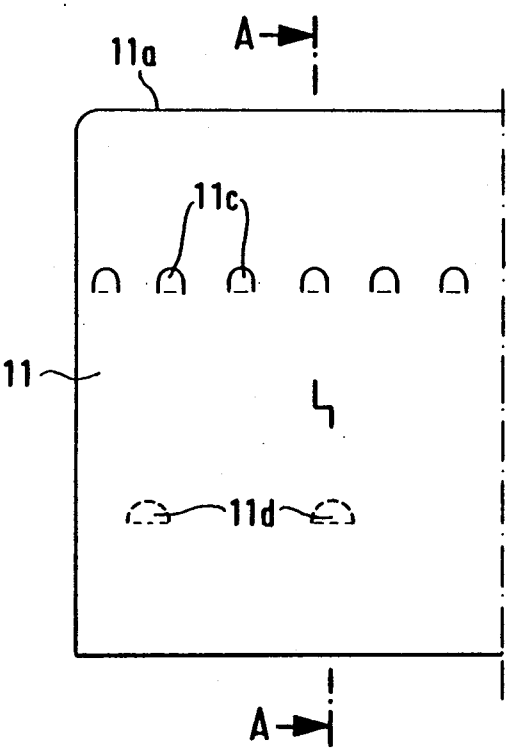
FIG. 15 shows an example of perforations at the tip of a loading blade.

The loading device 10 comprises a thin plate-like spring blade 11, whose tip 11*a* is rounded. The spring blade 11 extends as a unified construction across the entire width of the web W and the wire. The area of the tip 11*a* of the spring blade 11 may be provided with the perforation 11*c* shown in FIGS. 15 and 16, which will be returned to later. The spring blade 11 loads and drags against the inner face of the wire 40/50 by means of its wide side. At is opposite edge, the spring blade 11 is attached between fastening pieces 13 and 14 in connection with the frame part 12 of the loading device 10. The fastening of the spring blade 11 is ensured by means of grooves 15 provided in connection with the fastening piece 14, together with perforations 11*d* as shown in FIG. 15.

It is an essential feature of the construction and the material of the spring blade 11 that the blade 11 operates as a plate spring, by whose means, when it is loaded by one edge so that it becomes curved, a dragging and loading pressure is produced against the wire 40,50. The blade 11 is stationary, and most appropriately it drags "with the fur" against the wire 40,50 that is loads. Thus, the blade 11 fastening pieces 13,14 are placed, in the direction of running of the wires 40,50, before the dragging and loading area of the spring blade 11.

The former shown in FIG. 1 comprises a lower wire 40, which is guided by the guide rolls 43. After the headbox 45, the lower wire has a single-wire 40, which is guided by the guide rolls 43. After the headbox 45, the lower wire has a single-wire initial portion 40*a*, onto which the headbox 45 fees the discharge jet J. On the single-wire initial portion 40*a*, with the aid of the suction boxes 41*a*, water is drained through the lower wire 40 so that the pulp web $W_0$ reaches a suitable couching degree before it enters into the twin-wire zone.

The twin-wire zone starts at the guide roll 54 of the upper wire 50. Hereupon, in the twin-wire zone, there is a MB*TM* unit 60 modified by means of the loading devices 10*k* of the invention. After the MB unit 60, the twin-wire zone is curved upwards on the hollow-faced 55' forming roll 55, which is followed by a forming shoe 41*b*, which is provided with a ribbed deck 42. Thereupon, the twin-wire upper zone follows a downwards inclined run at which there are suction flatboxes 47 the upper wire 50 is separated from the lower wire, and the web W is transferred over the suction box 49 onto the pick-up felt 70 on the suction zone 71*a* of the pick-up roll 71. If no MB TM unit 60 is employed, the run of the upper wire 50 may be similar to the path 50' indicated by means of the dashed line.

Figure 6:
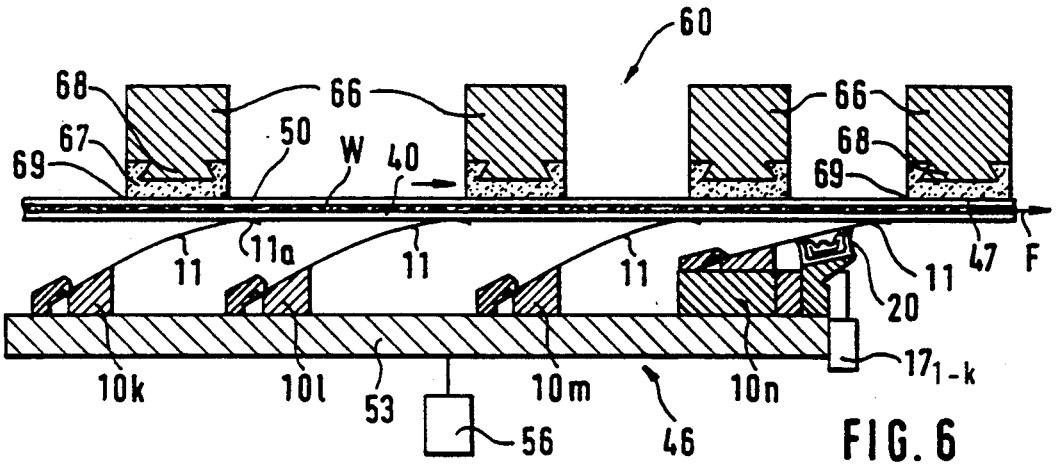
FIG. 6 is a vertical sectional view in the machine direction of the location of a group of loading devices in accordance with the invention inside the loop of the lower wire on a twin-wire straight forming zone, in which there are subsequent dewatering ribs inside the upper-wire loop.

According to FIG. 1, loading devices in accordance with the invention are fitted at the lower unit 46 of the MB unit in the way shown in FIG. 6 in more detail. At the forming roll 55, the loading device 10*a* is effective inside the loop of the lower wire 40 and, in corresponding way, on the top of the deck 42 of the forming shoe 41*b*, there is the loading device 10*b*. On the suction flatbox 47, there is the last loading device 10*c*. According to what is needed in each particular case, there may be one or several loading devices 10 in operation or out of operation.

Figure 2:
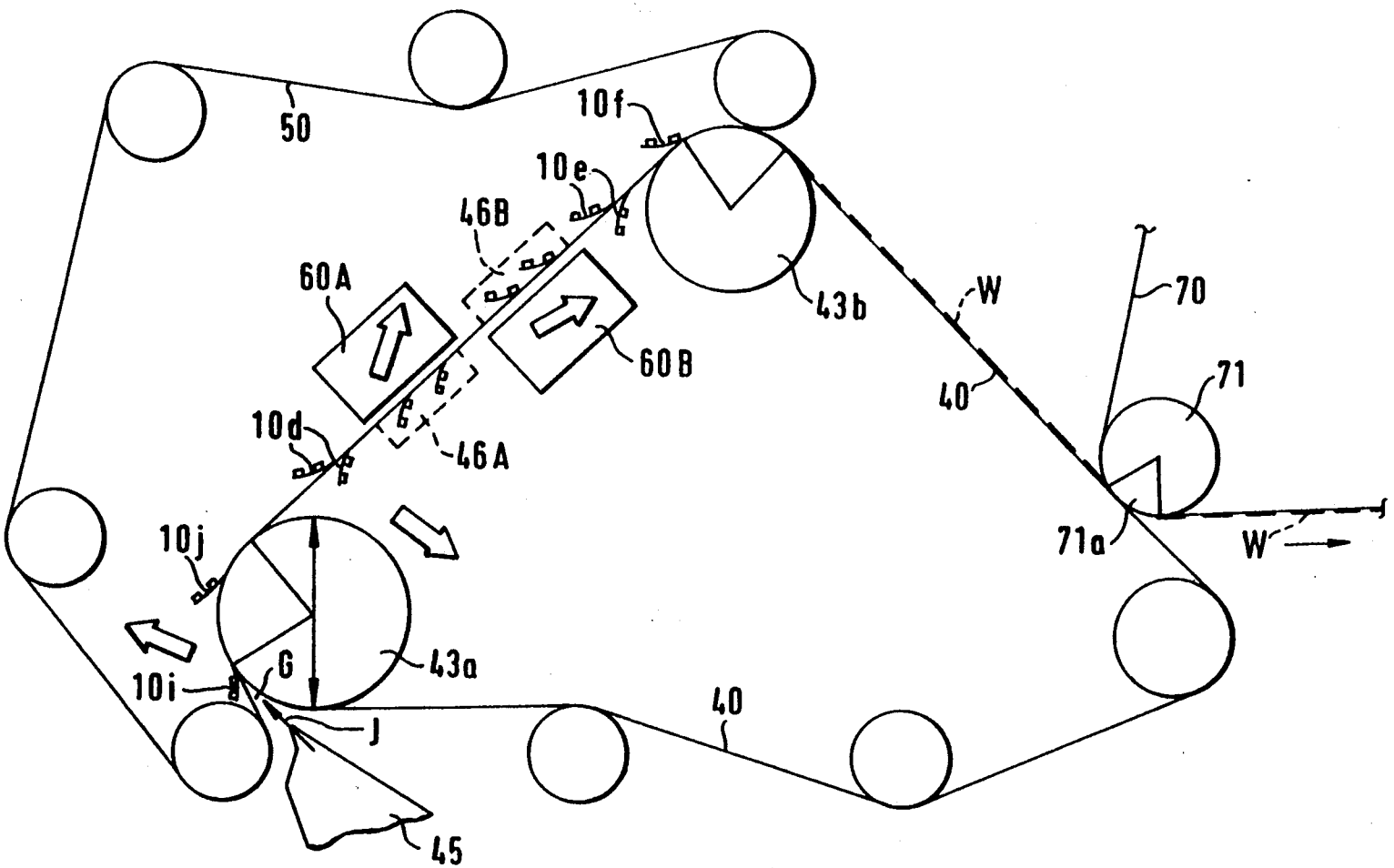
FIG. 2 shows a former provided with a MB TM unit, in which former a number of loading devices in accordance with the invention are employed.

FIG. 2 shows a twin-wire former, in which a number of loading devices 10*d*, 10*e*, 10*f*, 10*i*, 10*j* in accordance with the invention are employed. The lip part 45 of the headbox feeds the pulp suspension jet J into the forming gap G, whereupon the twin-wire zone begins on the forming roll 43*a*. Against the covering wire 50, in the area of the gap G, there is the first loading device 10*i*, and after it, on the twin-wire curved sector of the forming roll 43*a*, the second loading device 10*j*. After the forming roll 43*a*, the wires 40, 50 have a joint straight run, on which, directly one opposite the other or at a small distance from one another, there are the loading devices 10*d*. After this, on the twin-wire zone, there is the first modified MB TM unit 46A, 60A, which is followed by a corresponding inverted unit 46B,60B, whose basic construction comes out, e.g.,, from the assignee's FI Pat. Appl. No. 885608.

In FIG. 2, the latter MB TM unit 46B,60B is followed by two loading devices placed one opposite the other or by two corresponding devices 10*e* placed at a short distance from one another in the direction of running of the web W. The twin-wire zone is curved downwards on the sector of the latter forming roll 43*b*. On this sector, there is the loading device 10*f*. The web W is separated from the covering wire 50, and it follows the carrying wire 40, from which the web W is transferred onto the pickup fabric 70 on the suction zone 71*a* of the pick-up roll 71.

In the following, mainly with reference to FIGS. 9 to 12, the most important features of the loading device in accordance with the invention will be described.

Figure 3:
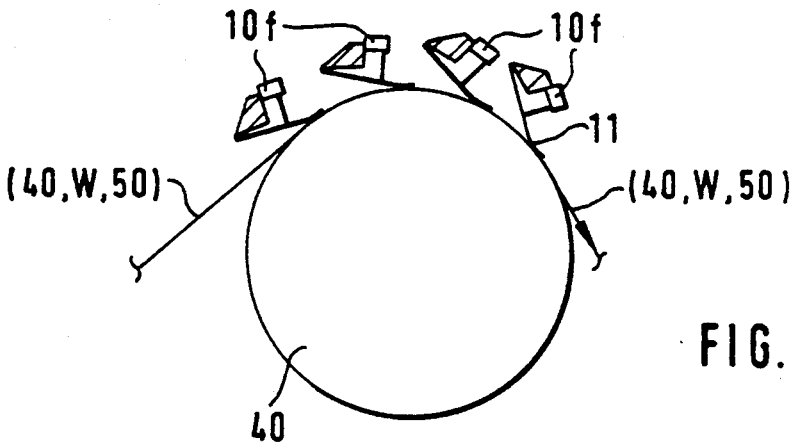
FIG. 3 shows locations in accordance with the invention of wire loading devices on a twin-wire web forming sector of a former roll or suction roll.

In FIG. 3, a group of loading devices is shown in which there are four loading devices 10*f* placed one after the other on a twin-wire 40,50 web forming zone on the curved sector of a forming roll or suction roll 10. The group of loading devices 10*f* is placed inside the loop of the outer wire 40 to give a pressure pulse against the inner face of the wire to promote the dewatering, to improve the formation, and/or, if necessary, also to control the different transverse profiles of the web W.

Figure 4:
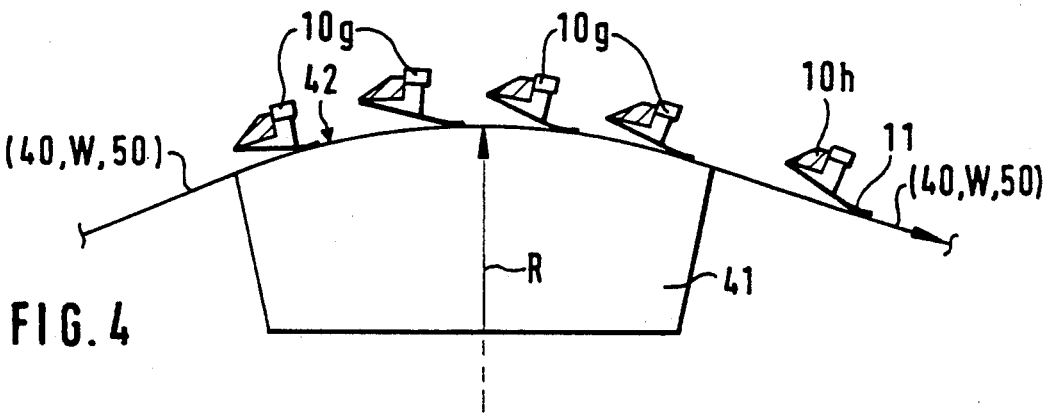
FIG. 4 shows a location of a group of wire loading devices in accordance with the invention on and after a forming shoe provided with a curved and closed or open ribbed deck.

FIG. 4 shows the use of a groups consisting of four subsequent loading devices 10*g* at the side opposite to the guide deck 42 of a curved (curve radius R) forming shoe 41 on a twin-wire zone as dragging against the inner face of the loop of the outer wire 40. Further, a loading member 10*h* is shown as fitted after the forming shoe 41 on the straight run of the wires 40,50 after the shoe 41. In operation and as installed, as needed, there may be one or several loading devices 10.

Figure 5:
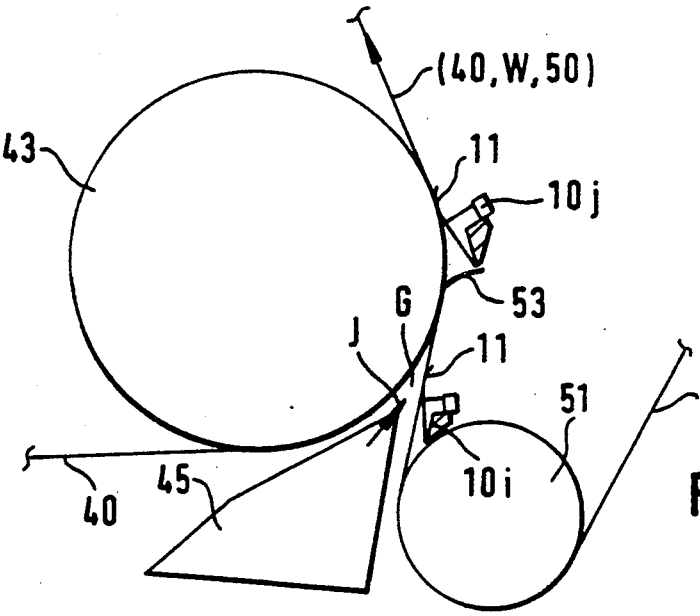
FIG. 5 illustrates the use of loading devices in accordance with the invention in the gap area of a gap former and on a curved sector of a forming roll after the gap area.

FIG. 5 is a more detailed illustration of the gap area of a gap former, wherein the lip part of the headbox 45 feeds the pulp jet into the gap G between the wires 40 and 50, which gap is defined between the runs of the wires 40 and 50 guided by the rolls 43 and 51. On the run of the outer wire 40 that is placed between the break roll 51 and the forming roll 43, a wire loading device 10*i* in accordance with the invention is arranged in such a way that its spring blade 11 acts upon the wire 50 in the area in which the pulp suspension jet J meets the wire 50 or the wires 40/50, or immediately after the pulp suspension jet has met the wire. Hereupon, inside the loop of the wire 50, there is a dewatering member 53, which is followed by the second loading device 10*j*, which operates against the inner face of the wire 50 loop opposite to the forming roll 43 and whose spring blade 11 presses against the inner face of the loop of the outer wire 50 so as to promote the dewatering, to improve the formation, and/or to regulate the different transverse profiles. As needed, only one or both 10*i*/10*j* of the loading devices 10 may be in operation.

FIG. 6 shows the beginning of the twin-wire zone of a former, for example, as shown in FIG. 1. The overall construction of the former shown in FIG. 6 may be similar to that shown in FIG. 1. Drawbacks of said formers include in particular wire damage arising from pulp bundles and lumps, resulting above all from the loading ribs placed "hard against hard". In view of eliminating these drawbacks and achieving the other objectives of the invention, inside the loop of the lower wire 40, against the loading ribs 66, a group of wire loading devices 10 in accordance with the invention are fitted, which are provided with a spring blade 11 and attached to the frame part 53.

The loading ribs 66 shown in FIG. 6 are provided with a wear piece 67, whose plane face glides against the inner face of the outer wire 50. The pieces 67 are attached to the loading ribs 66 by means of dovetail joints 68. The front side 67 of the pieces is provided with a blade edge 69, which separates water from the inner face of the wire 50 efficiently.

Loading devices 10*k*, 10*l*, 10*om* and 10*n* in accordance with the invention drag against the inner face of the wire 40 "with the fur" and load the wire. In the direction of running F of the wires 40 and 50, the area of effect of the first device 10*k* against the wire 40 is between two loading ribs 66. The loading area of the next loading device 10*l* is placed facing the rib 66, so also that of the next loading device 10*m*. The loading area of the last loading device 10*m* is placed facing the last rib 66.

The frame 53 is placed in suitable guides (not shown) so that the frame part 53 as a whole can be shifted in the vertical direction by means of power units 54, which are illustrated just schematically. In this way, the dragging force of the loading devices 10*k* . . . 10*n* can be adjusted. Moreover, the last loading device 10*n* is provided with profiling devices $17_{l\text{-}k}$, 10, which are illustrated in more detail in FIG. 9. These profiling devices include a hose 20, by whose intermediate, by means of a series $17_{l\text{-}k}$ of loading spindles 17, the loading force of the spring blade 11 of the last loading device 10*n* against the inner face of the wire 40 is regulated.

Figure 7:
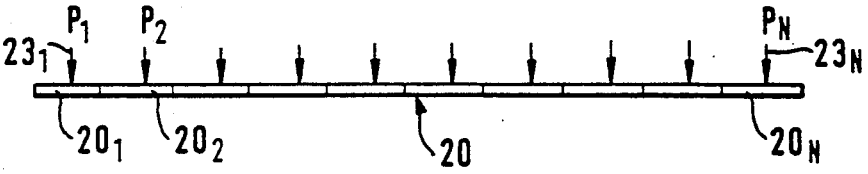
FIG. 7 is a schematic illustration in the machine direction of a loading member by whose means the loading of the blade of the device can be profiled.

FIG. 7 is a schematic illustration in the machine direction of a exemplifying embodiment of the profiling hose 20 for the loading force of the blade. The hose 20 has been divided into compartments $20_l$ . . . $20_N$, by means of which pressure it is possible to act upon the transverse distribution of the force (linear load) with which the tip area of the spring blade 11 presses against the face of the wire 40,50 placed against it. In this way, it is possible to regulate various transverse profiles in the fiber layer or web W that is being formed, such as profiles of dewatering, formation, filler distribution, retention, and/or grammage.

Figure 8:
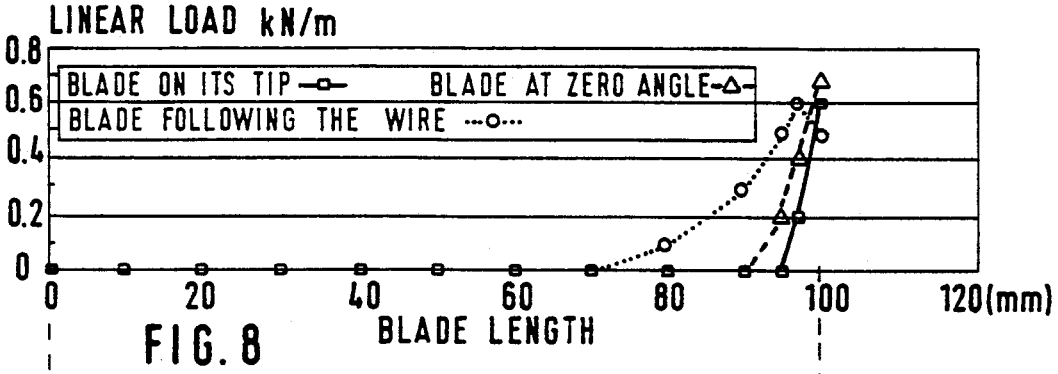
FIG. 8 is a graphic illustration of the linear load of a loading member as shown in FIG. 9 across the length of the blade.
Figure 9:
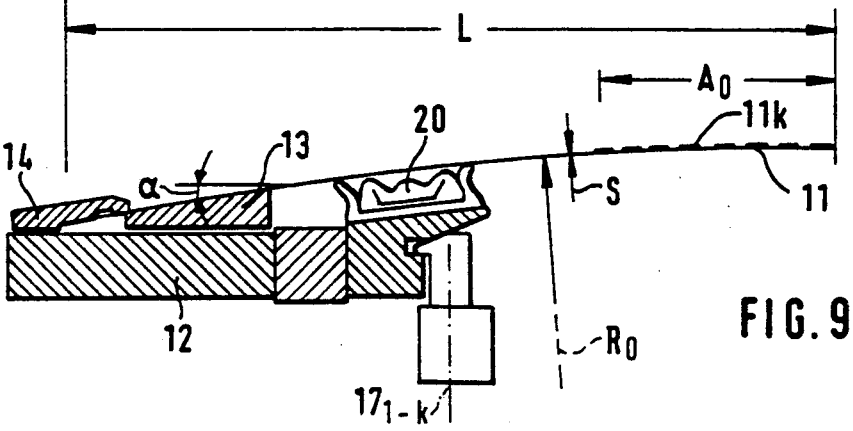
FIG. 9 is a vertical sectional view in the machine direction of a loading member in accordance with the invention with its profiling means.

FIG. 8 illustrates the distribution of the linear load (kN/m) produced by the spring blade 11 of a loading device 10 as shown in FIG. 9 across the length of the blade (in the machine direction) with different blade angles, i.e. with the blade 11 on its tip, the blade 11 following the wire, and the blade at zero angle. From FIG. 8 it is seen that the length of the loading area $A_0$ of the blade in the longitudinal direction of the blade 11 depends decisively on the blade angel. The angle a of the fastening 13 is a $\approx 15°$. In FIGS. 8 and 9*k*, the blade length $L=100$ mm and the blade thickness $S=0.25$ mm. In such a case, the ratio L/S, which is important in view of the operation of the spring blade 11 in accordance with the invention, is $L/S=400$.

In the following, with reference to FIGS. 10 to 13, some preferred exemplifying embodiments of loading devices in accordance with the invention will be described.

Figure 10:
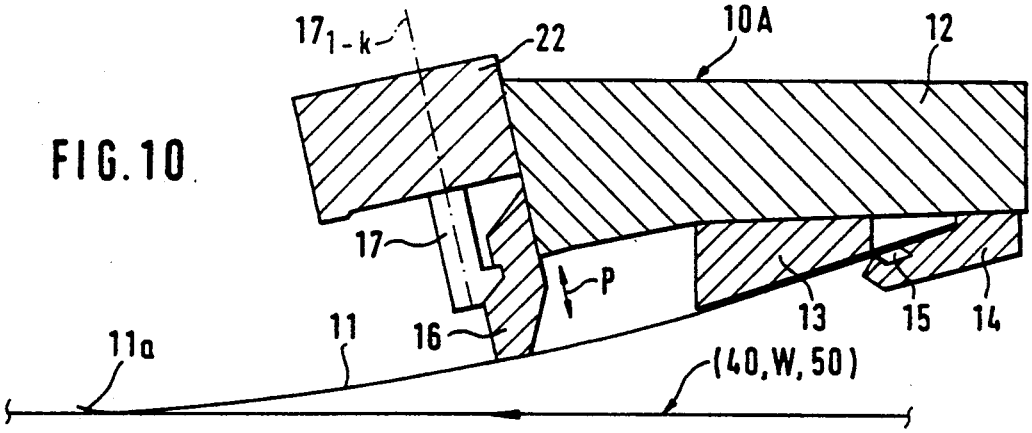
FIGS. 10, 11 and 12 are vertical sectional views in the machine direction of some alternative embodiments of the loading device in accordance with the invention.

According to FIG. 10, the loading device 10A comprises a frame part 12, in connection with which a spring blade 11 is attached by means of fastening parts 13,14,15, which spring blade has a straight or rounded tip 11*a*. In connection with the front side of the frame part 12, and intermediate frame 22 is fitted, to which a series $17_{l\text{-}k}$ of regulating spindles 17 is attached (k pcs. of regulating spindles placed side by side). By means of the regulating spindles 17, and adjustable force is applied to the spring blade 11 by the intermediate of an oblong flexible intermediate piece 16 so as to control the profile of the linear load of its loading force in the transverse direction of the web W.

The regulating spindles 17 act in the direction of the arrow P, and they operate in the same way as, for example, the regulating spindles of the profile bar of a headbox or corresponding regulating spindles of the coating blade in a paper coating device. The regulating spindles are placed at certain distances, preferably with a uniform spacing of from about 100 to about 200 mm. In such a case, the number k of the regulating spindles is, as a rule, $k \approx 100$. In FIG. 10, the frame part 12 of the loading device 10A is stationary, and the magnitude and the transverse profile of the linear load applied by the tip area of the spring blade 11 to the wire are regulated by means of the regulating spindles 17 described above.

It is an essential feature in the arrangement of the loading device 10A that the spring blade 11 is placed "with the fur" in relation to the direction of running of the wire 40,50. The water drained out of the web W through the wire 40;50 operates as the lubricant for the dragging area of the spring blade 11. If necessary, the loading device may also be provided with water supply devices, which lubricate the dragging area of the blade 11, for example, during starting of the paper machine and in connection with other disturbances in operation.

Figure 11:
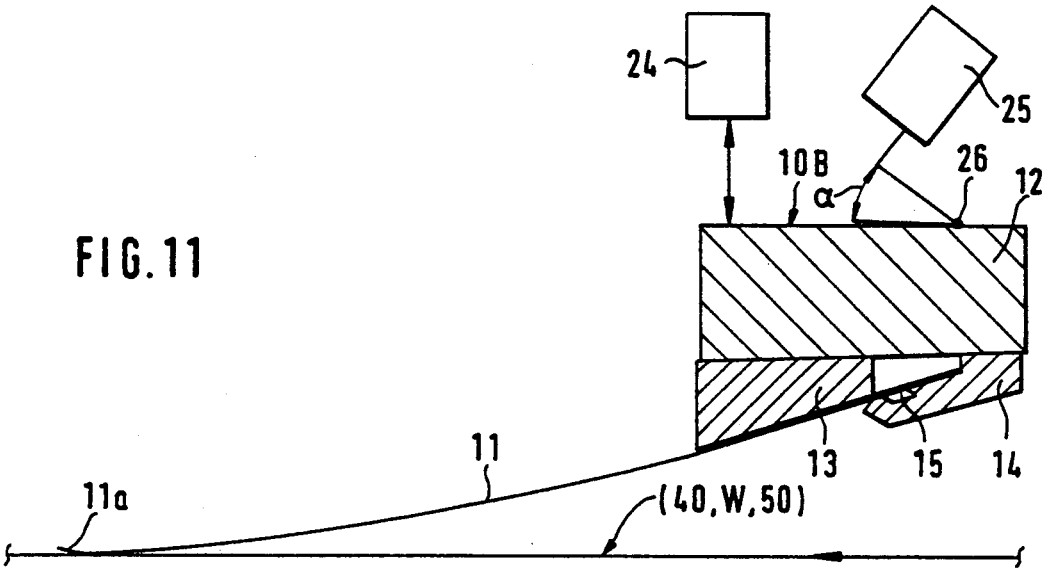

FIG. 11 shows a loading device 10B that provides no possibility of profiling of the linear load of the loading force, but the overall level of the linear load of the loading force is arranged adjustable, firstly, by means of power units 24, by whose means the frame part 12 is pressed in the vertical direction in FIG. 11, where by the spring blade 11 is deflected into curved shape and its linear load and the width of its area of effect are changed. Also, the loading force is arranged adjustable by rotating the frame part 12 around the axis 26 (angle a) by means of the power units 25. Said power units 24,25 can be arranged to act upon both ends of the frame part 12 in both of the lateral areas of the web W.

The construction of the loading device 10B, and so also of the other loading devices, can be, for example, such that the frame part 20 is, at both ends, attached, e.g., to axle journals, which or whose supports are attached to parts that are fixed permanently to power units or to the frame of the paper machine. The power units 24 and/or 25 are preferably provided as a pair, in which pair one loading device is placed at the operating side of the paper machine and the other one at the driving side.

Figure 12:
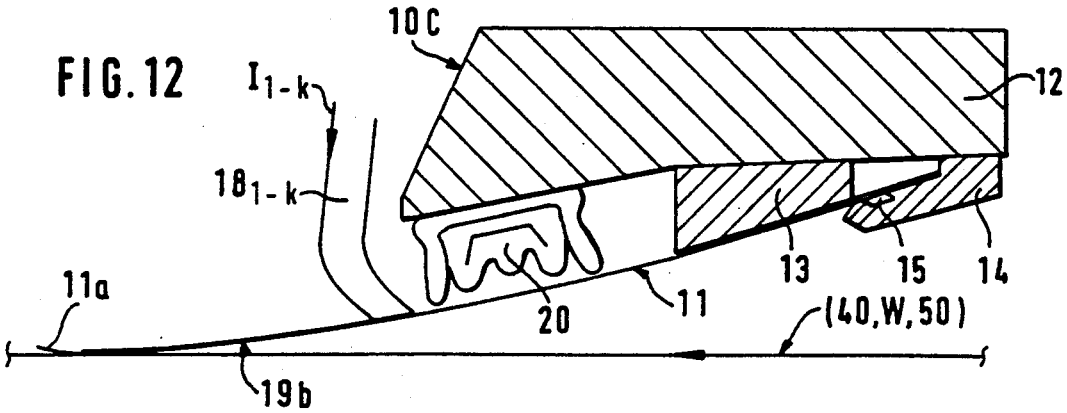

In FIG. 12, a loading device 10C in accordance with the invention is shown in which the overall level of the linear load of the loading force is arranged adjustable by means of a loading hose 20, into which an adjustable pressure is passed, which determines the dragging force applied by the spring blade 11 to the wire 40. The transverse profile of the loading force is arranged adjustable by, above the loading area of the blade 11, placing a series of film resistors 19*b*, to which adjustable heating currents $I_{l\text{-}k}$ are fed by means of electric conductors $18_{l\text{-}k}$. The series of film resistors 19*b* is covered by a thin heat insulator 19*a*. By regulating the electric currents $I_{l-k}$, it is possible to act upon the temperature distribution in the loading area of the spring blade and thereby upon the distribution of the elasticity coefficient in the loading area of the spring blade 11. In this way, the transverse distribution of the loading force in the device 10C can be regulated. In such a case, it is preferable that the blade material is chosen so that the elasticity coefficient is changed substantially with a rather little change in temperature. A suitable material is, e.g., plastic.

Figure 13:
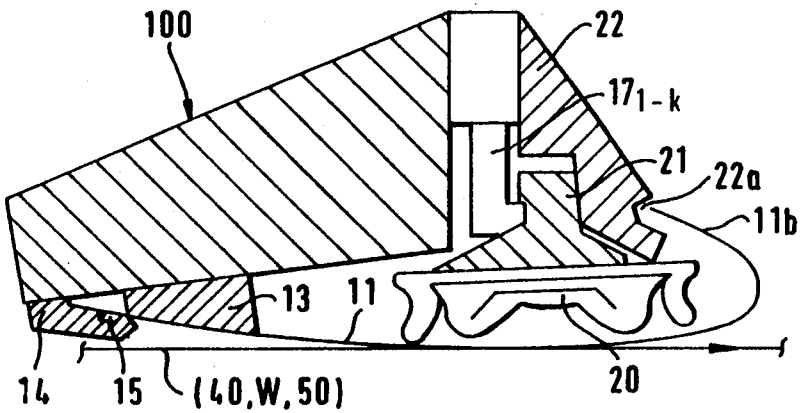
FIG. 13 shows a loading device which has quite a wide loading area, which, thus, has a low surface pressure.

In FIG. 13, a loading device 10D in accordance with the invention is shown in which the length of the loading area of the spring blade 11 in the machine direction can be made quite large by using a loading hose 20 of a large diameter. The tip area 11*b* of the spring blade 11, placed opposite to the fastening pieces 13,14,15, has been bent with a relatively large curve radius into the groove 22*a* in the front plate 22 of the loading device 10D so that the loading hose 20 remains inside the trough formed by the blade 11. In this way, a relatively closed construction is provided, which remains clean. The hose 20 is loaded by the intermediate of a flexibly intermediate piece 21 by means of a series $17_{l-k}$ of regulating spindles described above so as to regulate the profile of the loading force.

Figure 14:
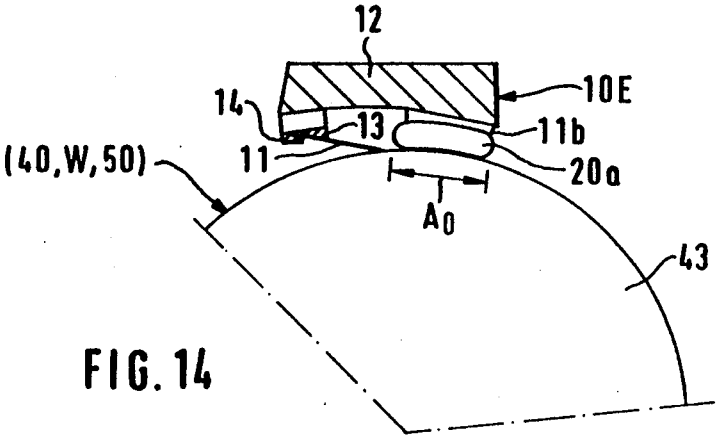
FIG. 14 illustrates an application of a wire loading device, for example that shown in FIG. 13, to wet pressing on a twin-wire sector of a forming roll.

In FIG. 14, an application of a loading device 10E in accordance with the invention to wet pressing is shown. The wet pressing takes place on the sector $A_0$ of the forming roll 43, the magnitude of which sector is preferably of an order of $A_0 \approx 200$ mm. The hose 20*a* is quite wide, and by its intermediate a gentle wet pressing of quite a low pressure is applied to the fibre layer between the wires 40 and 50, in which layer the dry solids content $k_a$ is still quite low, being at least $k_a = 8\%$, typically $k_a > 10\%$.

Figure 17:
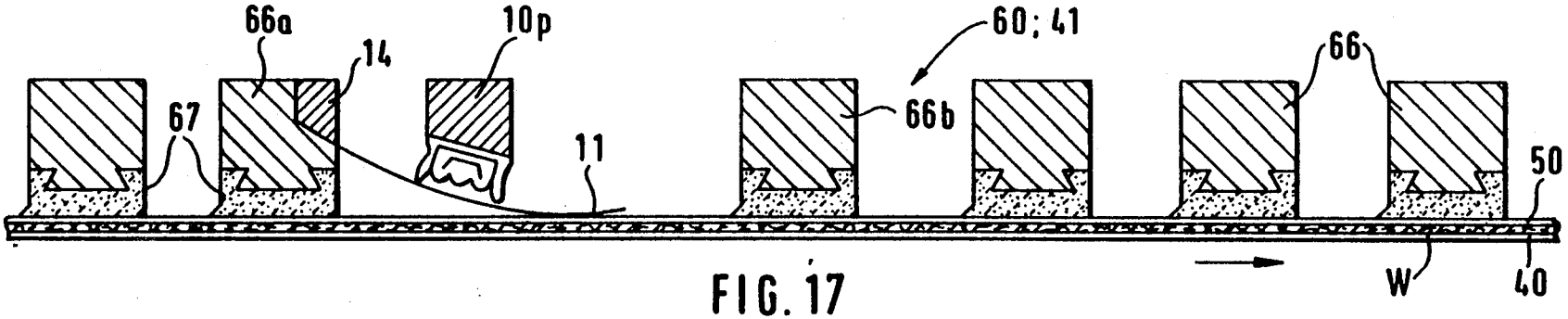
FIG. 17 shows the location of a loading device in accordance with the invention, for example, between, or in the place of, one or several ribs on a draining box or forming shoe shown in FIG. 1 or on the forming shoe shown in FIG. 4.

As is shown in FIG. 17, for example, in a draining box 60 as shown in FIG. 1, a rib or ribs placed against the wire 50 can be replaced by a loading device 10*p* in accordance with the invention, whose spring blade 11 drags "with the fur" against the inner face of the wire 50. According to FIG. 17, the spring blade 11 of a loading device 10*p* in accordance with the invention has been attached to the rib 66*a* by means of a fastening piece 14. A corresponding arrangement may be provided, e.g., in the ribbed deck 4 of a forming shoe 41*b* as shown in FIG. 4 or in the ribbed deck of a forming shoe 41 as shown in FIG. 4.

Figure 18:
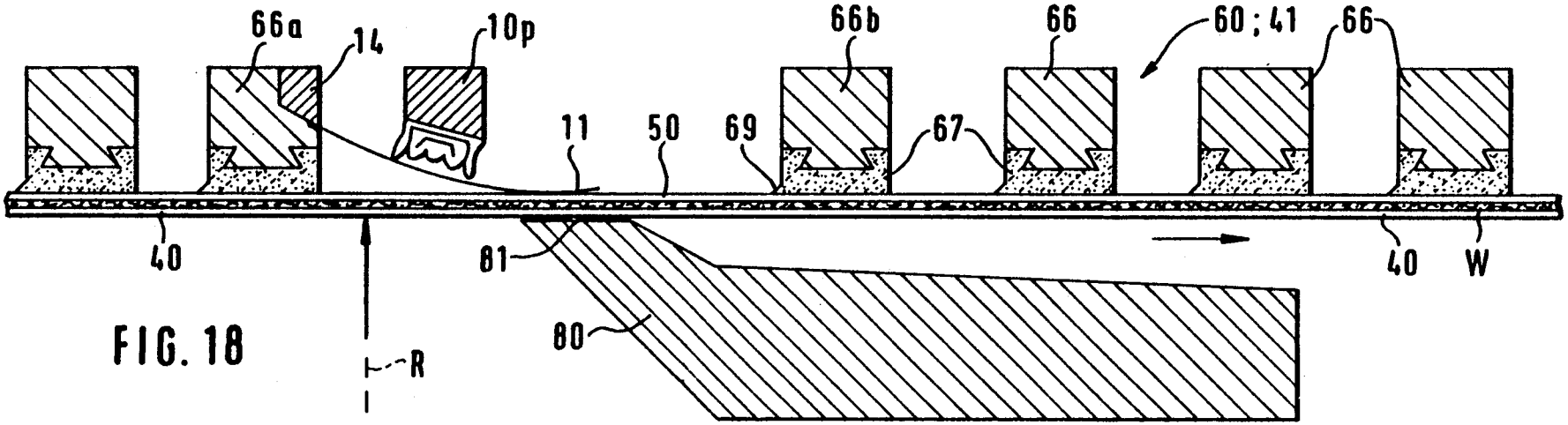
FIG. 18 shows a loading device in accordance with the invention as fitted so as to intensify the operation of a deflector.

FIG. 18 shows a loading device 10*p* in accordance with the invention that intensifies the operation of a deflector 80. The back-up faces 81 of the deflectors 80, of which only one is seen in FIG. 18, guide the wire 40 so that it is curved with a relatively large curve radius R, which curve radius is, e.g., $R \approx 5000$ mm. To the rib 66*a* placed inside the wire 50 loop, by means of a fastening piece 14, the spring blade 11 of a loading device 10*p* in accordance with the invention is attached, whose loading area is placed facing the backup face 81 of the opposite deflector 80 so as to intensify the operation of the deflector 80. Loading devices 10*p* in accordance with the invention may be placed facing one or several deflectors 80 to intensify their operation in accordance with the principles described above.

As ascertained from the above, the spring blade 11 is made of a restorable flexible plate-like spring material. It is also essential that the ratio of the length L of the spring blade to the thickness S of the plate material is within a certain range. In the invention, said ratio is chosen within the range of L/S = from about 10 to about 1000. Optimal applications are usually found within the range of L/S = from about 300 to about 500. Said ratio L/S also depends on the material of the spring blade. As the blade material, preferably wear-resistant spring steel is used, such as stainless steel. Some plastic materials and composite and sandwich structures may also be possible. The spring blade 11 does not necessarily have to be of uniform thickness or of the same material or same construction across its entire length or entire width.

Another essential feature of the construction of the spring blade 11 is its spring action so that, when the blade 11 is loaded by means of loading devices, the shape of the blade plate in the machine direction can be deflected with a relatively large curve radius $R_0 \approx$ from about 200 to about 100 mm depending on the elasticity conditions and loads, and a wide dragging area against the wire 40,50 is produced. Thus, the material of the spring blade 11 must have suitable spring properties, and permanent deformations must not be produced in it. The spring blade 11 is dimensioned, and the spring properties of its material are, as a rule, chosen so that the elastic constant of the blade deflection per meter of width is in a range of from about 1.6 to about 0.02 kN/mm, preferably in a range of from about 0.1 to about 0.03 kN/mm. In particular in composite structures, the elastic constant may be different in the machine direction as compared with the transverse direction.

The area of the spring blade 11 that will load and drag against the wire 40,50 can, if necessary, be provided with a wear piece or with a wear-resistant coating, e.g. with a ceramic layer, which is, in FIG. 9, represented by the dashed line and the reference numeral 11*k*.

Figure 16:
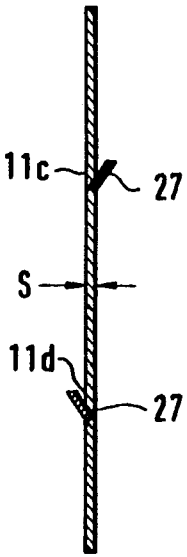
FIG. 16 is a sectional view taken along the line A—A in FIG. 15.

To promote the draining of water from the dragging and loading area of the spring blade 11, it is preferable to provide the area of the tip portion 11 of the blade with perforations, an example of which is shown in FIGS. 15 and 16. Into the plate material of the spring blade 11, a series of holes 11*c* have been punched, which are placed in a transverse row with a suitable short spacing. The diameter of the holes 11*c* is, e.g., $\approx 5$ mm and the spacing $\approx 10$ mm. The perforations 11*d* are provided for the fastening grooves 15. The tongues 27 produced on the making of the holes 11*c* and 11*d* are bent to the opposite side of the spring blade 11 away from its dragging area and from the wire 40,50.

Figure 19:
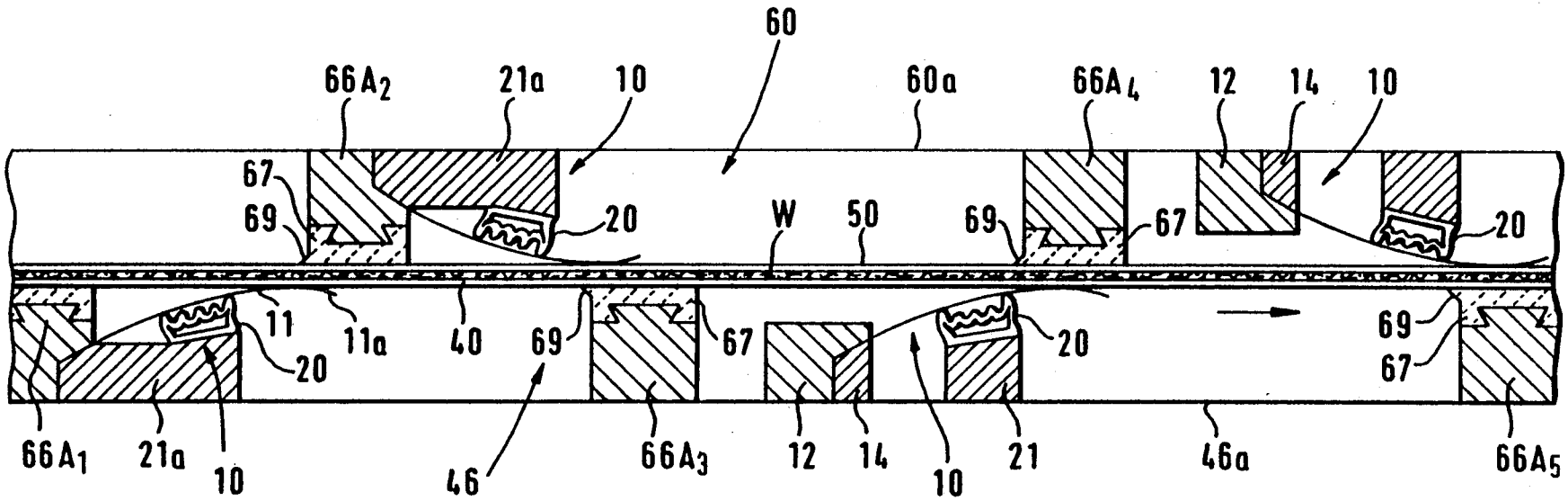
FIG. 19 is a vertical sectional view in the machine direction of a dewatering and wire loading device in accordance with the invention fitted on a twin-wire zone with a straight run.

FIG. 19 shows a dewatering and wire loading unit in accordance with the invention, which comprises an upper unit 60 fitted inside the wire loop 50 and a lower unit 46 fitted inside the wire loop 40, which units may be in the position shown in FIG. 1 or in the positions 46A, 60A and/or 46B, 60B shown in FIG. 2, or in some other positions, in particular on such twin-wire dewatering and forming zones whose runs are straight. According to FIG. 19, the forming ribs $66A_1$, $66A_2$, $66A_3$, $66A_4$ and $66A_5$ are placed alternatingly inside the opposite wire loops. In connection with the first forming ribs $66A_1$ and $66A_2$, a loading device is integrated, whose spring blade 11 is placed between the frame of the rib 66 and the frame piece 21*a* of the loading device 10. The loading hose 20 of the spring blade 11 is also supported on the frame piece 21*a*. Jointly operative with each of the forming ribs $66A_1 \ldots 66A_5$, there is the spring blade 11 of the loading device 10, whose dragging and loading area is placed, as is shown in FIG. 19, facing the Wear piece 67 of the forming rib 66. The, for example, ceramic wear pieces 67 of the forming ribs 66 and the dragging areas of the spring blades 11 form a resilient loading gap, through which the wires 40 and 50 and the web placed between them run. Said loading gap is in such a way resilient that, for example, pulp lumps do not cause damage to the equipment. Moreover, in particular when the solution shown in FIG. 20B is used, the twin-wire, substantially straight run can be made wave-shaped with a low amplitude. This, together with the alternation of the dewatering directions, promotes the formation of the web.

In the forming ribs 66 shown in FIGS. 19 and 20, there is a, for example, ceramic wear piece 67, whose plane face glides against the inner face of the wire 40 and 50, being lubricated by the water drained from the web. The pieces 67 are attached to the forming ribs 66 by means of dovetail joints 68. The front edge 67 of the pieces is provided with a ceramic tip 69, which doctors water efficiently from the inner faces of the wires 40 and 50. The forming ribs 66 and the loading devices 10 in the upper unit 60 and in the lower unit 46 are fitted, in the upper unit 60, in connection with the frame beam 60*a* and in the lower unit 46, in a corresponding way, in connection with the frame beam 46*a*. Of said frame beams 60*a* and 46*a*, only the inner sides are shown. From the lower unit 46, the dewatering takes place substantially by the force of gravity, aided by suction if necessary, and in the upper unit 60, suction-aided dewatering is employed, e.g. the AUTO-SLICE TM arrangements known in themselves.

Instead of the unit shown in FIG. 19, in which the constructions have been connected to the frame as a compact unit, it is also possible to employ various combinations of a forming rib 60 and a loading device 10 in different positions in twin-wire zones. The unit 46,60 shown in FIG. 19 improves the control of the alternation of the dewatering directions and the control of the pulse form.

Figure 20A:
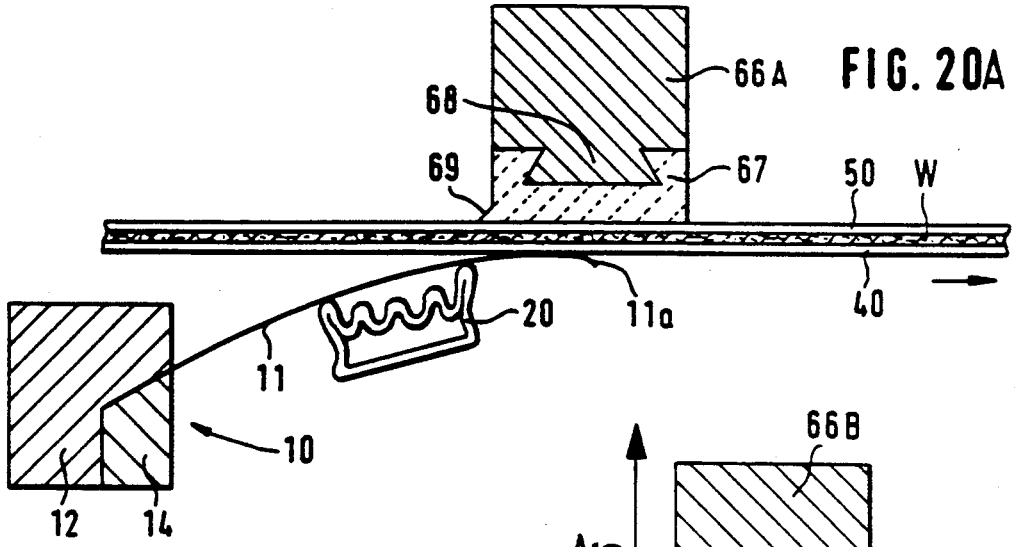
FIGS. 20A, 20B and 20C show different variations of fittings of the forming rib and the spring blade in a dewatering and wire loading device in accordance with the invention in relation to one another.
Figure 20B:
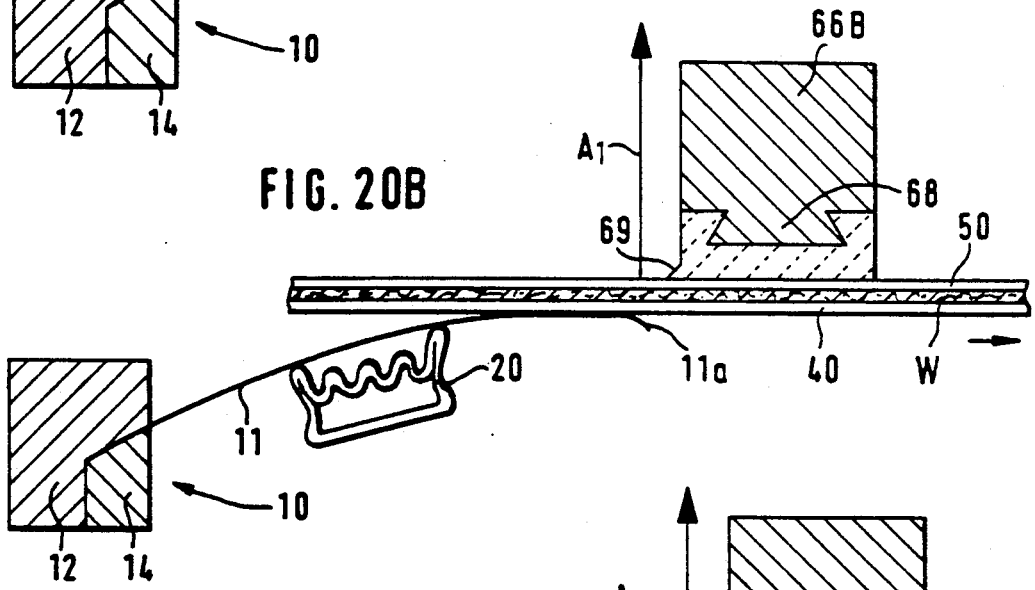

FIG. 20 shows different variations of different modes of relative fitting of the forming rib 66 and the spring blade 11 of the loading device 10. According to FIG. 20A, the tip 11*a* of the spring blade 11 is placed in the area of the dragging face of the wear piece 67 of the forming rib 66A, and the dragging area of the spring blade 11 is placed completely in the dragging area of the piece 67. In the construction shown in FIG. 20A, substantially just a pressure pulse is applied to the paper web W, which pulse has no substantial effect on the dewatering, but just on the other properties of the web W, such as the formation.

FIG. 20B shows an arrangement in which the dragging area of the spring blade 11 is placed right before the dragging are of the wear piece 68 of the forming rib 66B. In such a case, the pressure pulse at the tip 69 of the piece 68 corresponds to the pressure pulse produced by the negative pressure that may be applied and by the wire 50 tension, which pulse is increased by the pressure pulse produced by the pressure of the spring blade 11. The latter pressure pulse is effective by the intermediate of the dragging area of the blade 11 and presses the wires 40,50 against one another, which effect is favorable compared with negative pressure, because it does not attempt to separate the wires 40,50 from each other, which latter phenomenon may cause destruction (crushing) of the wire W structure. In FIG. 20B, by the joint effect of the rib 66B and the blade, water is removed substantially in the area of the arrow $A_1$ in the direction of said arrow.

Figure 20C:
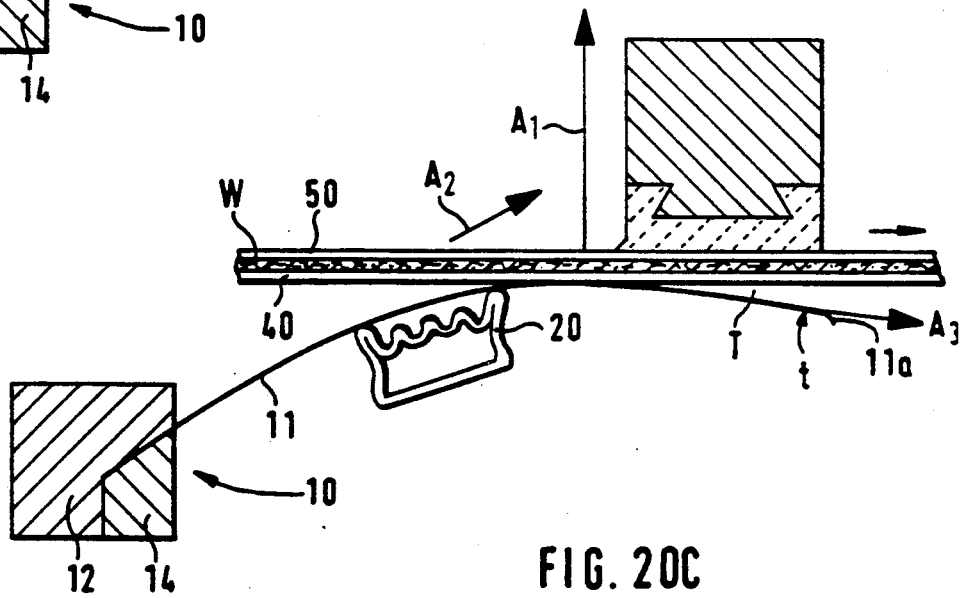

FIG. 20C shows an arrangement in which the area of effect of the spring blade 11 on the wire 40 extends both before the dragging area and in the dragging area of the wear piece 67 of the forming rib 66C. In such a case, together with the spring blade 11, the lower wire 40 forms a wedge space T that becomes wider in the running direction of the wires 40/50 in the area at the proximity of the tip 11*a* of the spring blade 11, the wedge angle of said wedge space T being denoted with t. The magnitude of said angle t is, as a rule, in the area $t=0° \ldots 5°$. The space T, which is opened at the angel t, removes water through the lower wire 40 in the direction of the arrow $A_3$, by means of the well-known foil effect. Also, water is removed through the upper wire 50 before the tip 69 of the piece 67 in the directions and in the area of the arrows $A_1$ and $A_2$.

The support pieces 12,14 of the forming ribs 66A,66B and 66C and/or of the spring blade 11 and/or the loading hose 20 and/or any other loading device may be provided with setting or regulation means by which the relative positions of the forming ribs 66 and the spring blades 11 and/or the loading forces of the blade can be regulated optimally, e.g.e, to the different positions shown in FIGS. 20A, 20B and 20C and to intermediate positions between them.

In the following, the patent claims will be given, and the different details of the invention may shown variation within the scope of the inventive idea defined in said claims and differ from the details described above for the sake of example only.

What is claimed is;

1. A wire loading device in a paper machine for applying a mechanical load across an entire width of a wire having a running direction in the paper machine, by means of which load a pressure pulse is applied to a fiber layer or web placed on support of the wire or between the wire and a second wire, by means of which pressure pulse the dewatering of the web is promoted, the formation of the web is improved, and/or the transverse profiles of different properties of the web are controlled, comprising a frame part, a flexible plate-shaped spring blade, said spring blade having a dragging area structured and arranged to drag against an inner face of the wire in the running direction of the wire to produce a pressure pulse to a fiber layer or web, said spring blade being attached, from outside its dragging area, to said frame part, said spring blade having a length (L) and a thickness (S), the ratio of the length of said spring blade to the thickness of the flexible plate material of said spring blade being in the range of L/S is from about 10 to about 1000, such that said spring blade follows variations in the thickness of the fiber layer or web, said loading device further comprising loading means for producing said pressure pulse, said loading means structured and arranged to deflect said spring blade into a curved profile to produce a dragging area against the wire.

2. The loading device of claim 1, wherein the ratio of the length of said spring blade to the thickness of the flexible plate material of said spring blade being in the range of L/S is from about 300 to about 500.

3. The loading device of claim 1, wherein the shape of said spring blade is deflected to a curve radius from about 200 mm to about 1000 mm.

4. The loading device of claim 1, wherein said spring blade includes a tip portion provided with perforations to promote the draining of water from said dragging area of said spring blade.

5. The loading device of claim 1, wherein another wire defines with the wire a pair of wires defining a twin-wire zone, the fiber layer or web running between said pair of wires in said twin-wire zone.

6. The loading device of claim 1, wherein water is removed from the fiber layer or web in the direction opposite from said spring blade.

7. An arrangement in a paper machine, comprising wire or wires guided by guide rolls, said wire or wires supporting a web or a fiber layer to be dewatered and having a running direction, a wire loading device for applying a mechanical load across an entire width of at least one of said wire or wires such that a pressure pulse is applied to a fiber layer or web, said wire loading device including a frame part and a flexible plate-shaped spring blade, said spring blade having a dragging areas structured and arranged to drag against an inner face of said at least one wire in the running direction of the wire or wires to produce said pressure pulse to the fiber layer or web, said spring blade being attached, from outside its dragging area, to said frame part, said spring blade having a length (L) and a thickness (S), the ratio of the length of said spring blade to the thickness of the flexible plate material of said spring blade being in the range of L/S is from about 10 to about 1000, such that said spring blade follows variations in the thickness of the fiber layer or web, said loading device further comprising loading means for producing said pressure pulse, said loading means structured and arranged to curve said spring blade in a machine direction.

8. The arrangement of claim 7, wherein said spring blade is attached to said frame part from an inlet side of said wire or wires.

9. The arrangement of claim 8, wherein said loading means comprises a power unit connected to said frame part, said power unit structured and arranged to move said frame part in a direction substantially perpendicular to the running plane of said wire or wires so as to affect the load on said wire or wires applied by said spring blade.

10. The arrangement of claim wherein said loading means comprises a power unit connected to said frame part, said power unit structured and arranged to rotate said frame part around a horizontal transverse axis of said frame part so as to affect the load on said wire or wires applied by said spring blade.

11. The arrangement of claim 8, wherein said loading means is arranged adjustably and controllably to affect the distribution of the linear load of said dragging area of said spring blade in the transverse direction.

12. The arrangement of claim 11, wherein said loading means comprises a plurality of regulating spindles, the linear load in the dragging area of said spring blade being regulated by means of actuator motors acting upon said spindles.

13. The arrangement of claim 11, wherein said loading means comprises a hose-like member which is divided into compartments in a longitudinal direction thereof, and in the transverse direction of the fiber layer or web, into which compartments adjustable pressures of a pressure medium can be passed.

14. The arrangement of claim 11, further comprising an heating means structured and arranged to regulate the regulating the distribution of the temperature of the dragging area of said spring blade in the transverse direction.

15. The arrangement of claim 11, wherein said dragging area of said spring blade is provided with a wear-resistant wear piece and/or coating.

16. The arrangement of claim 11 wherein said wire or wires comprise a first and a second wire, said first and said second wires defining a twin wire zone, the fiber layer or web being supported on said first and said second wires guided by guiding rolls to define first and second wire loops, respectively, said first and second wire loops being structured and arranged one opposite the other, further comprising a plurality of forming ribs placed alternatingly inside said first and second wire loops, said wire loading device being fitted as jointly operative with each of said forming ribs and located inside the opposite wire loop to said forming rib, said spring blade having a side arranged substantially parallel to the run of said first and second wires and dragging along an inner face of an associated wire loop in the area of said forming rib placed inside the opposite wire loop and/or, in the direction of running of the wires, substantially immediately before the area of said rib.

17. The arrangement of claim 16, wherein said forming ribs are arranged so that they can be set or regulated in view of regulation of the loading force applied by said spring blade to the wire.

18. The arrangement of claim 16, which comprises two loading and dewatering units placed one opposite the other in a substantially straight-running section of said twin-wire zone, each of which units has, in the direction of running of said first and second wires, alternating forming ribs and loading devices.

19. The arrangement of claim 16, comprising a wear piece attached to each of said forming ribs by means of dovetail joints, said wear pieces including a plane face having a front tip which glides against an inner face of said first or second wire in a dragging area of said wear pieces, said dragging area of said spring blade of an associated loading device being placed substantially immediately before said front tip of said wear piece in the direction of running of the wires inside the opposite wire loop to the wire loop where said forming rib is located.

20. The arrangement of claim 19, wherein an area placed after the dragging area of said spring blade of said loading device is arranged to form a wedge space widening in the direction of running of the wires and facing said wear piece of said forming rib placed inside the opposite wire loop, such that water is removed from the fiber layer or web by means of a foil effect in the wedge space.

21. The arrangement of claim 18, in said loading and dewatering units, at least one of said forming ribs and loading devices are integrated as a unit having a common frame.

22. The arrangement of claim 16 which is located in a counter-unit of a dewatering unit operating by means of suction, on a curved sector of a web forming roll, said arrangement further comprising a curved forming shoe in said twin wire zone, said forming shoe including a guide deck, one of said loading devices being located on an inner face of an outer one of said wires opposite to said guide deck.

23. The arrangement of claim 22, wherein another one of said loading devices is fitted along a straight run of said wires in the direction of running of said wires after said forming shoe.

24. The arrangement of claim 7, wherein said wire or wires comprises a pair of wires defining a twin-wire zone, the fiber layer or web running between said pair of wires in said twin-wire zone.

25. The arrangement of claim 7, wherein water is removed from the fiber layer or web in the direction opposite from said spring blade.

* * * * *